US005085898A

United States Patent [19]

Welteke et al.

[11] Patent Number: 5,085,898

[45] Date of Patent: Feb. 4, 1992

[54] INSULATING BOARD CONTAINING NATURAL FIBRES

[76] Inventors: Uwe Welteke, Graustrasse 3; Claus R. Szypura, Hugo-Preuss-St. 41; Reinhard Welteke, Wahlershaeuser Str. 4, all of D-3500 Kassel; Gottfried Erb, Schloss, D-Hungen, all of Fed. Rep. of Germany; Claus R. Szypura; Reinhard Welteke, both of Kassel; Gottfried Erb, Hungen, all of Fed. Rep. of Germany

[21] Appl. No.: 368,331

[22] PCT Filed: Dec. 4, 1987

[86] PCT No.: PCT/DE87/00575

§ 371 Date: Jun. 5, 1989

§ 102(e) Date: Jun. 5, 1989

[87] PCT Pub. No.: WO88/04347

PCT Pub. Date: Jun. 16, 1988

[30] Foreign Application Priority Data

Dec. 4, 1986 [DE] Fed. Rep. of Germany ..... 3641464

[51] Int. Cl.[5] ..... B32B 5/16

[52] U.S. Cl. ..... 428/2; 428/537.5; 428/903.3

[58] Field of Search ..... 428/2, 903.3, 537.5

[56] References Cited

U.S. PATENT DOCUMENTS

| | | | |
|---|---|---|---|
| 3,741,863 | 6/1973 | Brooks | 428/2 X |
| 3,819,456 | 6/1974 | Enfield | 428/2 X |
| 3,949,036 | 4/1976 | Nelson | 428/2 X |
| 4,111,730 | 9/1978 | Balatinecz | 428/2 X |
| 4,410,573 | 10/1983 | Narymskaya et al. | 428/2 |
| 4,507,358 | 3/1985 | Takaoka et al. | 428/537.5 X |
| 5,011,741 | 4/1991 | Hoffman | 428/903.3 X |

FOREIGN PATENT DOCUMENTS

| | | | |
|---|---|---|---|
| 3545001 | 7/1986 | Fed. Rep. of Germany | 428/903.3 |

*Primary Examiner*—Henry F. Epstein

*Attorney, Agent, or Firm*—Foley & Lardner

[57] ABSTRACT

An insulating board, and a method for producing the same, wherein the insulating board is a mixture which includes discrete paper platelets having an edge length of 1 to 5 mm derived by comminuting newspaper or similar paoer free from any surface treatment or fillers and pretreated with an anti-rot additive, natural fibers having an edge length of 5 to 100 mm, an adhesive and/or a reaction promoter. There is also provided an apparatus for producing the insulating board which includes a cyclone separator with a dust remover at its top, a tangential inlet for a premix of the paper platelets, fibers and anti-rot additive, countercurrent flow nozzle for the adhesive and/or reaction promoter, a plurality of comb shafts and a star feeding lock, whreby underneath the star feeding lock further comb shafts are arranged under which there is a fall-shaft which opens into a molding station.

8 Claims, 1 Drawing Sheet

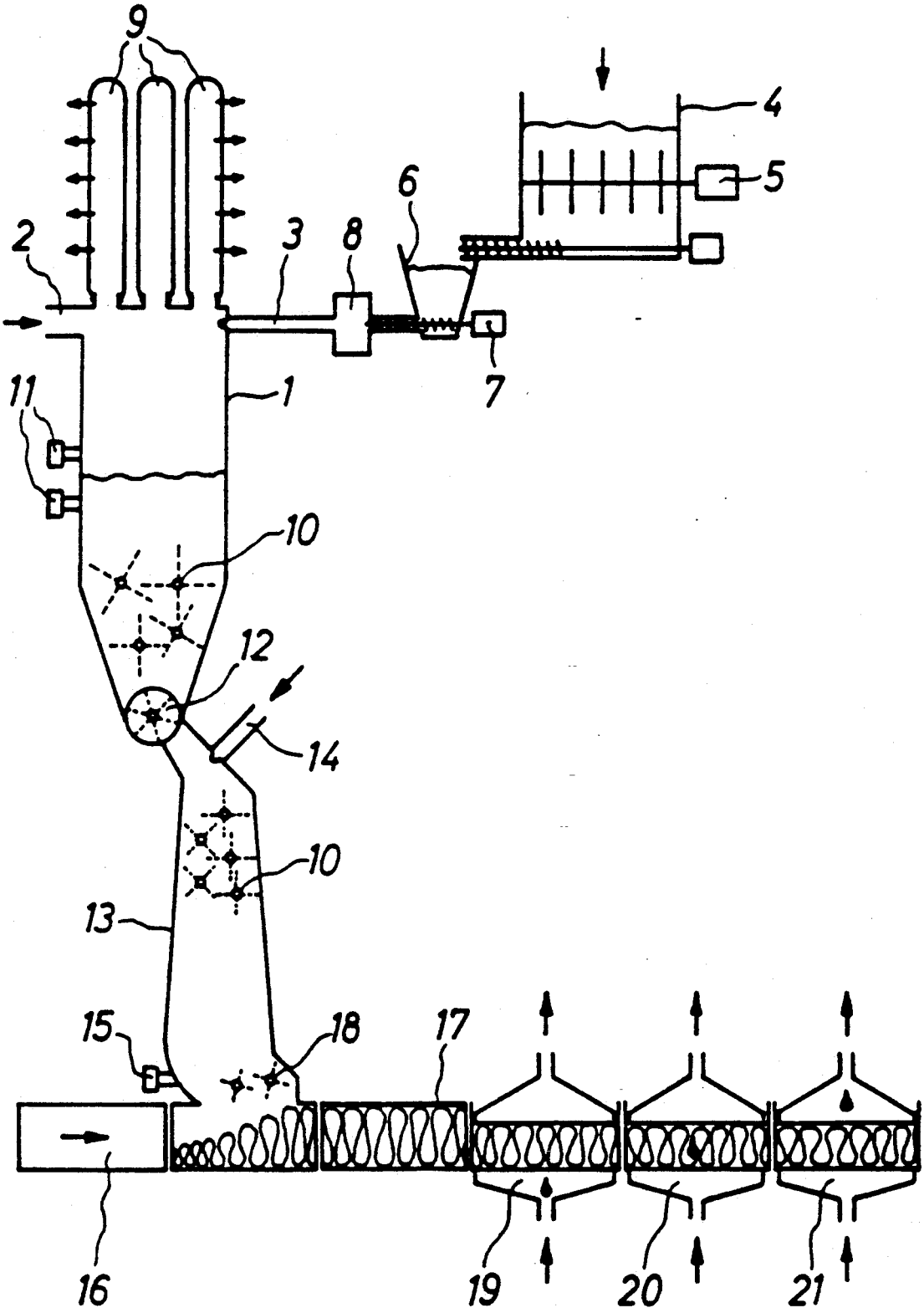
9
4
5
6
2
3
8
7
11
1
10
12
14
10
13
15
18
17
16
19
20
21

INSULATING BOARD CONTAINING NATURAL FIBRES

The present invention comprises an insulating board of ground up paper in a mixture with natural fibers such as jute or the like. For example, such an insulating board is described in the subsequently published German Patent Application P 35 45 001.0.

Such insulating boards contain at most negligible portions of synthetic chemicals. Therefore they are not harmful to the environment and comply with modern requirements for buildings and homes constructed with non-toxic, biological materials ("baubiologische Erfordernisse").

A substantial problem during the production is the heretofore unavoidable inhomogeneities in the final product, which impair on one hand the mechanical strength and on the other hand also cause a break-down of the composite during storage and transport. Therefore, it was the object of the present invention to improve such insulating boards, particularly to increase the mechanical strength, to bond the fibers more durably, and to provide a method and an apparatus for producing such boards.

The insulating board of the invention is made of a mixture of old newspapers or the like free from any surface treatment or fillers, pretreated with anti-rot additives, preferably borates, and comminuted into flakes with an edge length of 1 to 5 mm, of natural fibers, preferably having an edge length of 5 to 100 mm, and of adhesive and/or reaction promoters, preferably of vegetable origin.

It has been surprisingly discovered through experiments that the edge length and the form of the paper which is used have a decisive influence on the quality of the final product.

In comminution of the paper to a flake or platelike form with edge lengths as mentioned above products arise having a multitude of little hairs at their edges, which interweave especially well with the natural fibers during compression and from which the lignin component is especially readily activatable under the influence of heat and moisture to adhere to the natural fibers. Since the fillers or surface coatings which are, for example, in or on enamel paper interfere therewith, the types of paper used need to be free of them. Newspaper (even in printed form) has proved particularly useful, for example Quality "E12" from the raw material trade.

The necessary comminution to flake or platelike form of the required size is particularly successful in a hammer mill, whereby the dust portion of the milled product can be very small. It has been discovered that dust portions decrease the strength of the insulating board and increase the consumption of material.

The nature of the natural fibers is largely uncritical; suitable fibers include jute, sisal, cotton, coco-fiber, flax, recycling or waste material from spinning mills or prepared material from straw or wood or animal hair, preferably wool, preferably in a length from 5 to 100 mm. As adhesives or action promoters balsam resin such as colophronium, starch or lignin bonding agents, caoutchouc or also trass cement, gypsum, aluminum sulfate and waterglass may be used. The production of the boards can be carried out in such a manner, that the substances are mixed and loosened up, introduced into a mold, compressed to desired density, and heated and dried with hot air and/or hot steam.

Particularly the lignin components contained in the paper are thereby activated and utilized as binder.

A particularly effective method according to the invention is to premix the paper flakes and fibers, to blow the mixture into a mixing vessel and to countercurrently introduce adhesive, or adhesive and reaction promoter in reverse flow, optionally in the form of an aqueous solution. After that the mixture is loosened up, fed in free fall into a molding station and compressed and subsequently treated and dried with hot air or hot air and steam.

By doing so the components move together from different directions with a high relative velocity, so that a high homogeneity of the mixture is assured. The adhesives and optional reaction promoters can be sprayed into the flake and fiber stream in pulverized or molten form or in aqueous solution, and settle primarily on the surfaces of the particles.

The necessarily higher stream velocities lead to a certain precompression and orientation of the fibers, which are canceled again by mechanical loosening up. Subsequently the resulting loosened product is introduced continuously in free fall into the molding station and thereafter compressed. This causes the fibers to be uniformly distributed in the mold and enables a higher constancy of the mixing proportions to be maintained.

The compression of the material additionally achieves the desired orientation of the fibers and interlocking or felting of the fibers and flakes, which improve the bonding and lower the consumption of the glue. Subsequently the compressed material is treated with hot air or hot air and steam, whereby the glue components flow and subsequently bond.

Because, as already mentioned, dust portions interfere, it is proposed, to carry out the countercurrent mixing of flakes, fibers and glue components in a cyclone dust separator, whereby the substances are essentially carried away upwards tangential to the air and the dust up through the middle.

The subsequently collected and again mechanically loosened mixture can be treated during free fall into the molding station with hot steam (or hot air, if the internal moisture in the fibers is sufficient) in order to stretch and to swell the fibers, because this, according to their nature, can improve the resulting product.

The loosening up and separation of the components before introduction into the mold is of substantial importance. Therefore it is further proposed, to (continuously) collect the mixture of components produced by the countercurrent flow in a receptacle, provided with a mixing device for loosening up. By support of a lock, preferably a star feeder lock, the material is transferred outwards and mixed and loosened up again.

In this way undesired lump formation is safely avoided and the homogeneity is assured.

The "bond" of the boards is effected under mechanical pressure power, whereby hot steam or hot air, or both, depending on the existing and the required moisture for the activation of the glue which is used is conducted under elevated pressure through the compressed material. Subsequently the material is dried, for example by conducting dry air through it. The air can also be sucked through in order to produce a decrease in pressure and accelerate the evaporation.

The filling process can be varied in such a way that different mixtures are produced in separate mixing devices and these are then successively layered and subsequently pressed. Thus the outer layer can have higher adhesive and paper contents in order to make it smoother or to coat it with the aid of the adhesive, or depending on the intended use also contain increased proportions of longer or shorter fibers.

For continuous production it is proposed, to deposit the material, settling out of the fall shaft, on a perforated conveyor belt, with which an overlying perforated belt is associated. The latter has an angular catchment area converging in the transport direction which can be decreased to the desired dimension of the thickness of the board, and which opens into the hot steam and/or hot air supply and the drying station.

Because the material presents a high resistance to movement on the belt, it is proposed, to simultaneously laterally guide the product which is to be compressed, for example by special belts.

The apparatus of the invention comprises a cyclone with an upper tangential inlet for the fiber and flake mixture and a substantially oppositely disposed countercurrent flow inlet for the glue components. This mixture rotates peripherally and comes to the bottom of the cyclone, where it is collected and monitored by a level indicator. Filter bags are provided at the top for dust removal.

A rotating comb shaft is arranged in the collecting zone. Underneath this there is a star feeder lock, which feeds the material to a further mixing device, where it can optionally be treated with steam. Underneath the latter mixing device there is a fall shaft and below this is a filling station, whereby scraper shafts can be provided at the outlet.

BRIEF DESCRIPTION OF THE DRAWINGS

The accompanying drawing illustrates schematically the method and apparatus according to the preset invention.

The present invention will be explained in more detail with reference to the accompanying drawing:

The cyclone 1 has two oppositely directed, substantially tangential material inlets, which (serve for) feeding 2 for the premixture of paper flakes and natural fibers. This premixture contains the significant substances i.e. in addition to the paper flakes and the fibers, for example anti-rot additives, which can already be added during the milling of the paper.

The glue is blown into the rotating mixture in powder form, as a melt or in aqueous solution with the aid of a nozzle pipe 3. The storage tank 4 with mixer 5 and the dosing vessel 6 with helical discharge screw 7 serve to produce the glue. At the end of the helical discharge screw is a pressure duster which opens into the pressure nozzle 3. The feeding of the material is preferably done in the substantial absence of air and with high velocity, for which appropriate devices are available.

The overpressure caused in the interior of cyclone 1 by the introduction of material is simultaneously used for dust removal by the filtering bags 9 at the top of the cyclone 1. The cyclone 1 is equipped with a level indicator 11, which regulates the supply of material to prevent overloading. At the bottom of cyclone 1 mixing devices in the form of comb shafts 10 are arranged which homogenize the material and prevent a premature bonding of the glue through permanent motion. Underneath the comb shafts 10 is a lock, preferably a star feeder lock 12, for introducing controlled amounts of material into the fall shaft. Underneath the star feeder lock a steam treating device 14 can be provided, which serves for preswelling and stretching of the fibers.

Below the star feeder lock 12 at the top of the fall shaft 13 further mixing devices are arranged, preferably in the form of comb shafts which keep the material in permanent motion and convey it into the fall shaft 13 for scattering.

The fall shaft 13 is preferably constructed so as to diverge downwardly to prevent glue components added in molten form or in solution from caking on (the walls). At the foot of the fall shaft 13 there is also a level indicator, and below this is the molding station, which is shown here as a plurality of molding boxes 16 which are open at their tops. The material settles in these boxes 16 in a perfectly loose condition. The boxes 16 are movably mounted.

After filling of a box it arrives at a press 17, in which the loose bulk is compressed to the desired density. The press simply comprises a sheet of metal, perforated like the molding boxes 16, and fitted to the size of the boxes, which is placed on the filling and pushed down.

The perforated metal sheet can remain in place until the material is removed from the mold, however, it is also possible to apply individual perforated metal sheets in the following steps for holding down and detaching. The desired orientation and interlocking of the fibers thereby arises which strengthens the composite mechanically.

At the outlet of the molding boxes 16 from the fall shaft 13, scraper shafts can be arranged, which provide for a uniform degree of filling. Because the falling speeds of the mixture components are different, every start-up of the fall shaft results in a slight segregation due to the more rapid movement of the faster sinking components. Therefore the device is preferably started and kept in operation continuously.

The temperature treatment and moisture treatment steps follow the press 17. Hot air and hot steam can initially be blown in 19 to activate the adhesive and the activatable lignin components.

After that, compressed air 20 for drying can be blown in, and subsequently in a further step 21 either further dry air can be furnished, the exhaust of which can be used in 20 for pre-drying, or with the aid of vacuum the material can be dried in 21 to a residual moisture suitable for use in building.

After the boards are removed, the molding boxes are conveyed in a circuit. The degree of filling can be regulated by the scraper shafts 18 if they are adjustable in height.

The control of the temperature and moisture content is done as follows: a mixture of hot air and hot steam, the temperature and mixing proportions of which are controllable, is forced in through the openings of the underlying perforated metal sheets.

As soon as the inflowing gas mixture has displaced the air out of the material, which is slightly compressed by the lid, an overpressure is generated by partial closure of the suction valve, which promotes the subsequent moistening of the flake-fiber-glue mixture.

The gas mixture is supplied to the mold until the material is heated to just below the boiling point of the liquid contained therein. The moisture level must be sufficient to facilitate the debonding and reaction requirements, including the reactivation of the adhesives contained in the paper.

As soon as this moisture content is achieved in the material (preferably in the low range between 10 and 25 weight percent water absorption), the supply of the steam-air mixture is terminated, the overpressure is relieved and an underpressure is generated through the suction cover.

The renewed evaporation of the moisture is induced by controlled supply of hot air from the bottom panel and optionally by additional heating, and the resulting steam-air mixture is sucked out through the drying board into the suction cover =underpressure.

Through this procedure, the drying process of the boards doesn't require so much time until the moisture from the interior regions of the board diffuses outwardly through the salts and fiber materials, but is carried out substantially more rapidly by the air stream, which simultaneously brings with it energy for vaporization.

A further part of the energy for vaporization is contributed by controlling the pressure in the closed mold.

A residual moisture content slightly exceeding the moisture content suitable for use in building (approximately 10 percent weight moisture) can remain in the board. As soon as the moisture content decreases to such a level, the board can be final dried, removed from the mold and packaged.

Desired surface layers of paper construction materials which protect against moisture or wind can now be applied.

In appropriate cases, the treatment of the moist boards with hot air can bring about subsequent hardening of specific adhesives, for example lignin glues.

The consumption of energy of the overall plant can be optimized by minimizing heat losses by insulating the heat transporting conduits and surfaces and efficiently sealing (the system), as well as by recovery of heat from the final drying of the boards, the heat of condensation of the moist exhaust from drying, and the excess hot steam and hot air from the moisture treatment.

The moisturizing mixture can also be obtained by subsequent heating of the moist (steam-containing) exhaust from drying, and thus the moisture can be conducted in a circuit.

What is claimed is:

1. An insulating board comprising a mixture of discrete paper platelets having an edge length of 1 to 5 mm derived by comminuting paper substantially free from any surface coating or fillers and pretreated with an anti-rot additive, natural fibers having an edge length of 5 to 100 mm, and at least one component selected from the group consisting of an adhesive and aluminum sulfate.

2. An insulating board according to claim 1, wherein said paper is comminuted in a hammermill with a low dust content.

3. An insulating board according to claim 2, wherein said paper platelets are substantially free from dust portions.

4. An insulating board according to claim 1, wherein said natural fibers are selected from the group consisting of jute, sisal, cotton, coco-fiber, flax, straw, wood, and animal hair.

5. An insulating board according to claim 4, wherein said natural fibers comprise wool fibers.

6. An insulating board according to claim 1, wherein said adhesive is selected from the group consisting of colophonium, starch, lignin, caoutchouc, trass cement, gypsum, aluminum sulfate and waterglass.

7. An insulating board according to claim 1, wherein said paper comprises newspaper.

8. An insulating board according to claim 1, wherein said anti-rot additive comprises a borate.

* * * * *